United States Patent [19]

George

[11] Patent Number: 4,619,333

[45] Date of Patent: Oct. 28, 1986

[54] DETONATION OF TANDEM GUNS

[75] Inventor: Flint R. George, Katy, Tex.

[73] Assignee: Halliburton Company, Duncan, Okla.

[21] Appl. No.: 553,440

[22] Filed: Nov. 18, 1983

Related U.S. Application Data

[63] Continuation-in-part of Ser. No. 481,074, Mar. 31, 1983, Pat. No. 4,544,034.

[51] Int. Cl.[4] ..... E21B 43/117

[52] U.S. Cl. ..... 175/4.52; 175/4.54; 166/55; 166/297

[58] Field of Search ..... 175/4.52, 4.53, 4.54, 175/4.56, 4.58; 166/55, 297, 317, 383, 332–334; 102/200, 204, 322, 275.11, 275.6

[56] References Cited

U.S. PATENT DOCUMENTS 3,612,189 10/1971 Brooks et al. ..... 175/4.54

3,717,095 2/1973 Vann ..... 175/4.55 X

*Primary Examiner*—Stephen J. Novosad

*Assistant Examiner*—Thuy M. Bui

*Attorney, Agent, or Firm*—James R. Duzan

[57] ABSTRACT

Method and apparatus for perforating a cased borehole in a single trip into the well include two or more strings of perforating guns supported within the wellbore. The strings of guns are attached to the lower end of a pipe string and located downhole with one of the strings of guns adjacent a formation to be perforated. The first string of guns is then detonated by hydraulic actuation to perforate the formation. The pipe string is then adjusted to properly align the second string of guns either with the same formation or with another formation in the wellbore. The second string of guns may then be actuated by any known method such as impact or pressure actuation. This method and apparatus allows the same formation to be perforated twice thereby doubling the number of perforations in the cased borehole or permits the testing or completion of another formation in the same well.

29 Claims, 8 Drawing Figures

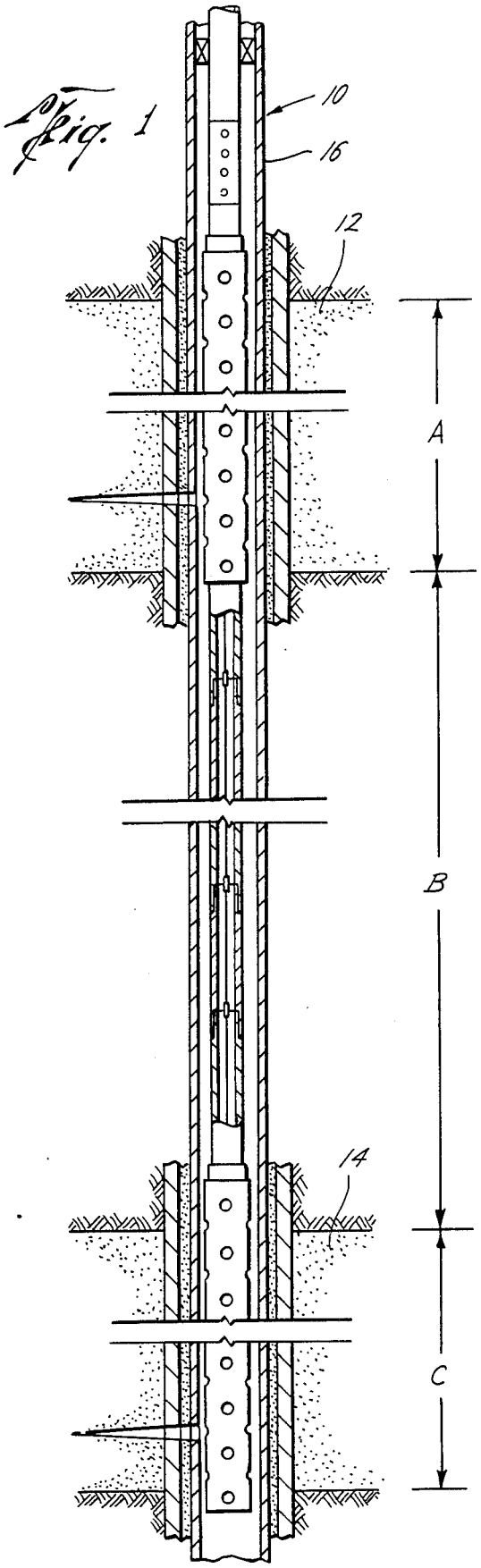
PRIOR ART
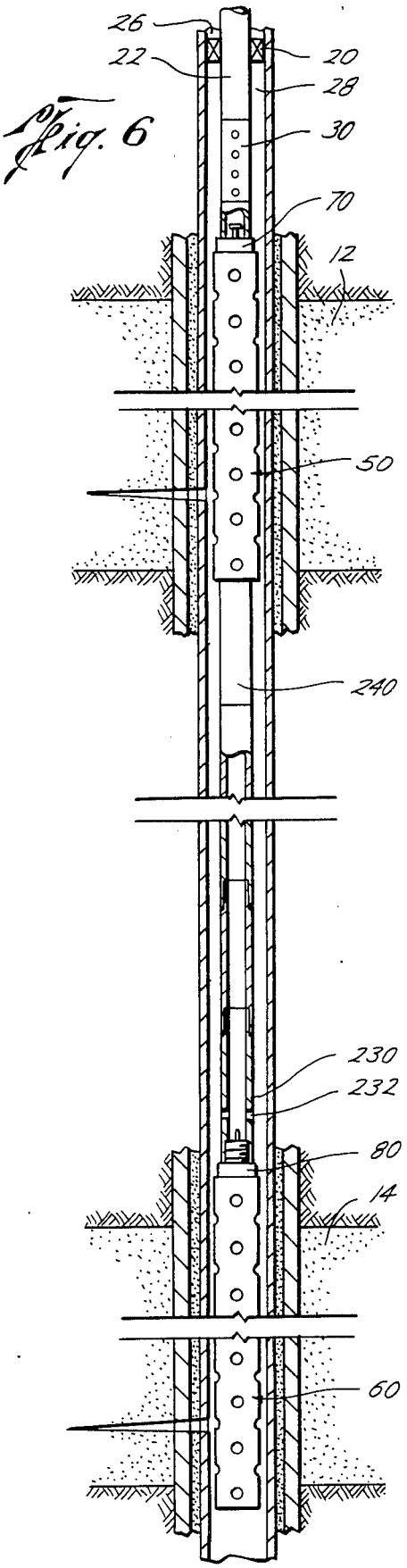

DETONATION OF TANDEM GUNS

CROSS-REFERENCE TO RELATED APPLICATIONS

This application is a continuation-in-part of my copending U.S. patent application Ser. No. 481,074 filed Mar. 31, 1983, now U.S. Pat. No. 4,544,034 entitled "Actuation of a Gun Firing Head" and is related to U.S. patent application Ser. No. 481,069 filed Mar. 31, 1983 entitled "Gun Firing Head".

BACKGROUND OF THE INVENTION

The present invention pertains to the perforation of cased boreholes and more particularly to individually perforating different formations or twice perforating the same formation in a single trip into the well.

After a wellbore has been formed into the ground and the casing has been cemented into place, the hydrocarbon-containing formation usually is communicated with the casing interior by forming a plurality of perforations through the casing which extend radially away from the casing and out into the formation, thereby communicating the hydrocarbon-containing formation with the interior of the casing.

It is now common practice to run a jet perforating gun downhole on a pipe string and to fire the gun by the employment of a gun firing head which is actuated by a bar dropped down through the interior of the pipe string. Completion techniques involving this known completion process are described in U.S. Pat. Nos. 3,706,344 and 4,009,757.

Many times it is desirable to perforate more than one formation located in the well. One prior method is to run a jet perforating gun downhole on a pipe string to a first formation, perforate the first formation, pull out the pipe string and expended gun, replace the used gun with a new perforating gun, run the new gun down to a second formation and perforate the second formation. This method requires two trips into the well.

Another method is illustrated in FIG. 1 of the drawings. A pipe string supports an upper and a lower string of perforating guns. A lower pipe string of a predetermined length and made up of individual pipe lengths, is disposed between the two strings of perforating guns whereby upon lowering the guns downhole, the upper and lower strings of guns are located adjacent the upper and lower formations, respectively, to be perforated in the well. A prima cord extends from the upper guns, through the lower pipe string, to the lower string of guns. Booster caps are required at the joints of the pipe lengths making up the lower pipe string to permit connection of the pipe lengths and the prima cord. The connections of the individual pipe lengths must be hermetically sealed since the prima cord would be rendered inoperative if the prima cord was not completely dry. One of the principal deficiencies of this method is that a trained crew must be used to assemble and lower the prima cord with booster caps and the hermetically sealed lower pipe string into the well. The requirement of hermetically sealed pipe precludes the use of pipe normally on hand at the drill site and special pipe must be brought to the drill site for this purpose. Many times the distance between the two strings of guns is several hundred feet. Further, this method has the deficiency in that the two formations must be perforated simultaneously since the strings of guns will be detonated together.

There are several problems with both of these methods. Drilling oil wells is expensive and each round trip adds to that cost. Another problem is that formations are usually far apart, often in the range of 600 to 900 feet, so providing hermetically sealed pipe is very expensive. The prima cord is also expensive. It is further desirable to be able to perforate the two formations independently so that the first formation can be perforated and then the other formation perforated at a later time.

The number of perforations per foot of formation adjacent the cased borehole is limited in a single trip into the well by the number of charges which can be disposed within a perforating gun. Charges must be of a particular size to contain sufficient explosive for the cased borehole to be perforated. Many times it is desirable to increase the number of perforations per foot of formation such as where a limited length of the cased borehole passes through the formation. Oftentimes in the past it has been necessary to lower a first string of guns into the well to perforate the formation and then, after removing the first string of guns, lower a second string of guns adjacent the formation of perforate the formation again thereby increasing the number of perforations per foot.

The present method overcomes the deficiencies of the prior art.

SUMMARY OF THE INVENTION

The method and apparatus of the present invention includes a pipe string supporting an upper and lower string of jet perforating guns in tandem or series. The lower string of perforating guns is mounted adjacent the lower end of the pipe string and the upper string of perforating guns is series connected in the pipe string above the lower string of guns. A packer is disposed on the upper portion of the pipe string above the upper string of guns to divide the casing/pipe annulus. A perforated nipple is series connected in the pipe string between the upper string of guns and the packer. The lower portion of the pipe string extending between the upper and lower strings of guns is ported to provide fluid communication between the flowbore of the lower pipe string and the casing/pipe annulus below the packer. The lower string of perforating guns includes a pressure actuated gun firing head such as is disclosed in U.S. patent application Ser. No. 481,074 filed Mar. 31, 1983 entitled "Actuation of a Gun Firing Head". The upper string of perforating guns includes a conventional mechanically actuated firing head such as is disclosed in U.S. Pat. No. 3,706,344. A flow path extends from the surface to the pressure actuated firing head of the lower string of guns. Fluid pressure may be displaced through the flowbore of the upper pipe string and into the lower casing/pipe annulus via the perforated nipple. Fluid pressure may then be displaced via the lower casing-/pipe annulus through the ported lower pipe string and effected upon the pressure actuated firing head of the lower string of perforating guns disposed on the lower pipe string.

In operation, the tandem strings of perforating guns are lowered into the cased borehole on the pipe string with the lower string of guns being located adjacent the formation to be perforated. The packer is set and hydraulic pressure is applied down the flowbore of the upper pipe string, through the perforated nipple and into the lower annulus, and then into the ported lower pipe string to actuate the pressure actuated firing head of the lower string of guns to perforate the formation. The pipe string is then adjusted to align the upper string of guns either with the perforated formation or with a second formation to be perforated in the well. The upper string of guns is then actuated by any known method such as impact or pressure actuation. This allows either the same formation to be perforated again thereby doubling the number of perforations in the formation or to test or complete a second formation in the well. Another variation of the method is to provide a predetermined length of the lower pipe string between the two strings of guns whereby the upper and lower strings of guns are located adjacent upper and lower hydrocarbon producing formations within the well. In this variation, the upper and lower strings of guns may be simultaneously detonated to perforate the two formations of the same time.

BRIEF DESCRIPTION OF THE DRAWINGS

For a detailed description of a preferred embodiment of the invention, reference will be made to the accompanying drawings wherein:

FIG. 1 is a partly diagrammatic, partly cross-sectional view of a well showing a prior art method and apparatus.

FIG. 6 is a partly diagrammatic, partly cross-sectional view of an alternate embodiment of the apparatus of the present invention.

DETAILED DESCRIPTION OF THE PREFERRED EMBODIMENT

Figure 2:
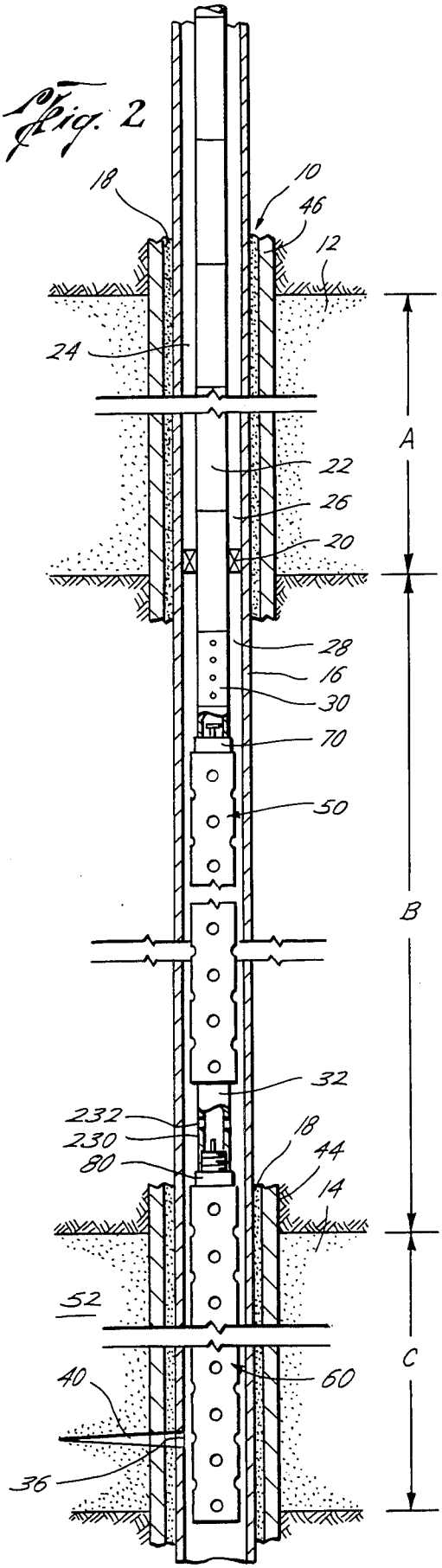
FIG. 2 is a partly diagrammatic, partly cross-sectional view of a well with a substantially vertical borehole with upper and lower formations and an apparatus of the tandem type, made in accordance with the present invention, in position to perforate the lower formation.

Referring initially to FIG. 2, there is disclosed a typical well having borehole 10 extending downhole from the surface of the ground (not shown) through a first or upper hydrocarbon-containing formation 12 and through a second or lower hydrocarbon-containing formation 14. The borehole 10 is cased by a string of casing 16 which is cemented into the borehole 10 as shown at 18. Casing 16 isolates the borehole 10 from upper and lower formations 12 and 14. A string of pipe 22, such as production tubing or drill pipe, is suspended within casing 16 and extends from the surface axially through casing 16. Production tubing string 22 within casing 16 forms borehole annulus 24 extending from the bottom of the well to the surface, and packer 20, disposed on tubing string 22, divides the borehole annulus 24 into upper annulus 26 and lower annulus 28.

In order to complete the well or test the formations, it is necessary to access the hydrocarbons in formation 12 and/or formation 14 with that portion of the annulus extending below packer 20, i.e., lower annulus 28. This is accomplished by supporting one or more perforating guns 50 from a perforated nipple 30 near the lower end of tubing string 22. Perforating guns 50, i.e., the last gun in the string of perforating guns, supports a lower or connector pipe string 32 of a predetermined length which in turn supports a second string of perforating guns, i.e., one or more perforating guns 60. For purposes of this description, the first and second strings of perforating guns will be limited to one perforating gun, namely guns 50 and 60. Guns 50, 60 are preferably jet casing guns, but it should be understood that the term is extended to include any means for communicating the hydrocarbon-containing formations 12, 14 with annulus 24. The jet perforating gun of the casing type shoots metallic particles into the formations 12, 14 to form perforations 36, 38 and corresponding channels or tunnels 40, 42 (See also FIG. 3).

During the drilling of the borehole 10, the formation pressures are controlled by weighted drilling fluid, filtrate and perhaps fines which invade the formation, interacting with in situ solids and fluids to create contaminated zones 44, 46, reducing permeability, and leaving on the face of formations 12, 14 a low-permeability filter cake. The cementing operation also includes fluids and fines which invade and damage formations 12, 14 at the contaminated zones 44, 46. Thus, the jet perforating guns 50, 60 of the casing type using shaped charges, must penetrate deeply into formations 12, 14 to form tunnels 40, 42 that pass through casing 16, cement 18, and contaminated zones 44, 46 and into the uncontaminated or sterile zones 52, 54 of formations 12, 14. Perforations 36, 38 and tunnels 40, 42 form the final passageways which enable the hydrocarbons to flow from formations 12, 14 through tunnels 40, 42 and perforations 36, 38 and into lower annulus 28 for movement to the surface.

Figure 4:
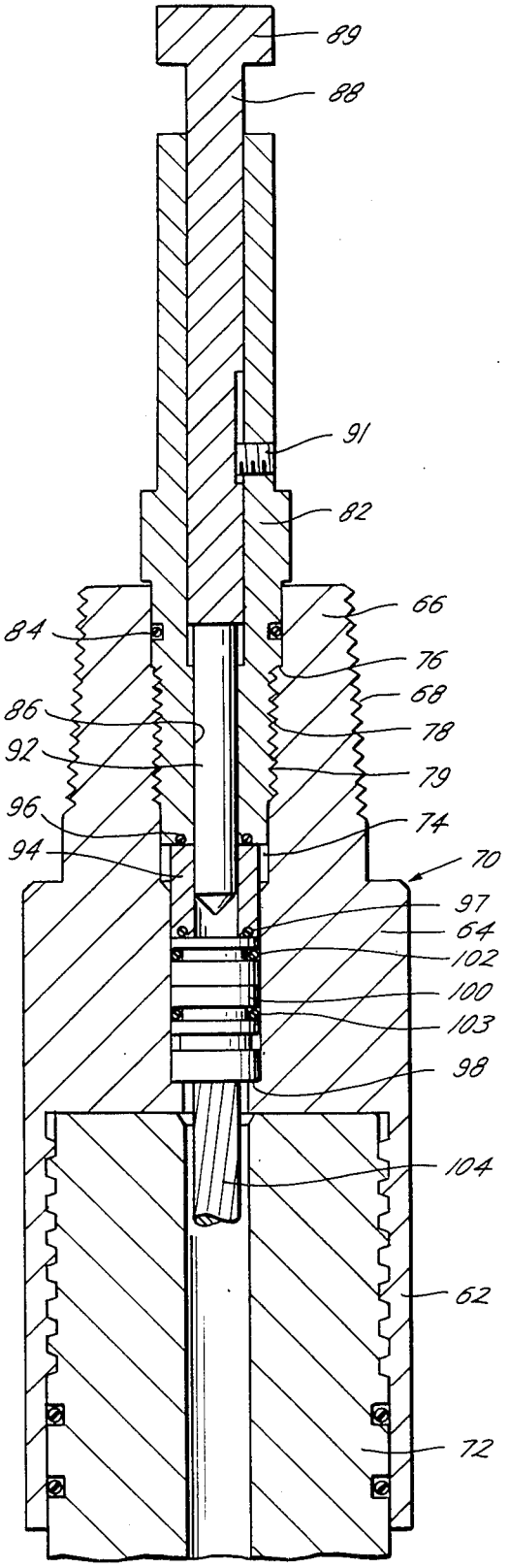
FIG. 4 is an enlarged cross-sectional view of a mechanically actuated firing head.

Upper perforating gun 50 includes a conventional firing head 70, such as an impact actuated firing head shown in FIG. 4 and described in U.S. Pat. No. 3,706,344 or an electrically actuated firing head as are well known to those skilled in the art, and lower perforating gun 60 includes a pressure actuated firing head 80, such as that illustrated in FIG. 5 and described in U.S. patent application Ser. No. 481,074 filed Mar. 31, 1983, entitled "Actuation of a Gun Firing Head."

Referring now to FIG. 4, there is disclosed impact actuated firing head 70 which includes a cylindrical housing 64 with a reduced diameter portion or pin 66 which is telescopically received and connected to the lower end of the tubing string 22. Pin 66 is threadingly engaged within the end of the drill string by external threads 68 on pin 66 and internal threads on the lower end of the tubing string 22 (not shown). The lower end of housing 64 includes a lower threaded box end 62 for threadingly receiving a sub 72 on the upper end of perforating gun 50. The upper end of housing 64 has a central bore 74 with an internal shoulder 76. Below the shoulder 76 there are internal threads 78 for threadingly engaging the external threads 79 of impact actuator housing 82, with an O-ring seal 84 sealing between the impact actuator housing 82 and housing 64. Impact actuator housing 82 has a central bore 86 which telescopically receives plunger 88 having a head 89. Plunger 88 is restrained from accidental movement by pin 91. The lower end of plunger 88 is in contact with the upper end of firing pin 92 which is telescopically received within the lower end of central bore 86 of the impact actuator housing 82. Firing pin 92 has a slightly upward taper to prevent it from blowing out of bore 86 upon actuation. The lower end of firing pin 92 is encircled by a collar 94 with O-ring seals 96, 97 at the collar's upper and lower ends. The lower end of central bore 74 of housing 64 has an internal shoulder 98 that supports initiator 100. Initiator 100 supports a plurality of seal rings 102, 103 on its exterior for sealing engagement with the inner surface of bore 74. A prima cord 104 extends from a booster beneath the initiator 100 and communicates with the shaped charges of gun 50 whereby upon impact of initiator 100 by firing pin 92, the booster is detonated which initiates prima cord 104 to detonate the charges of gun 50. Firing head 70 is actuated by a weight, such as a bar, dropped through tubing string 22 which strikes plunger 88 and forces firing pin 92 into initiator 100 to detonate gun 50.

Figure 5:
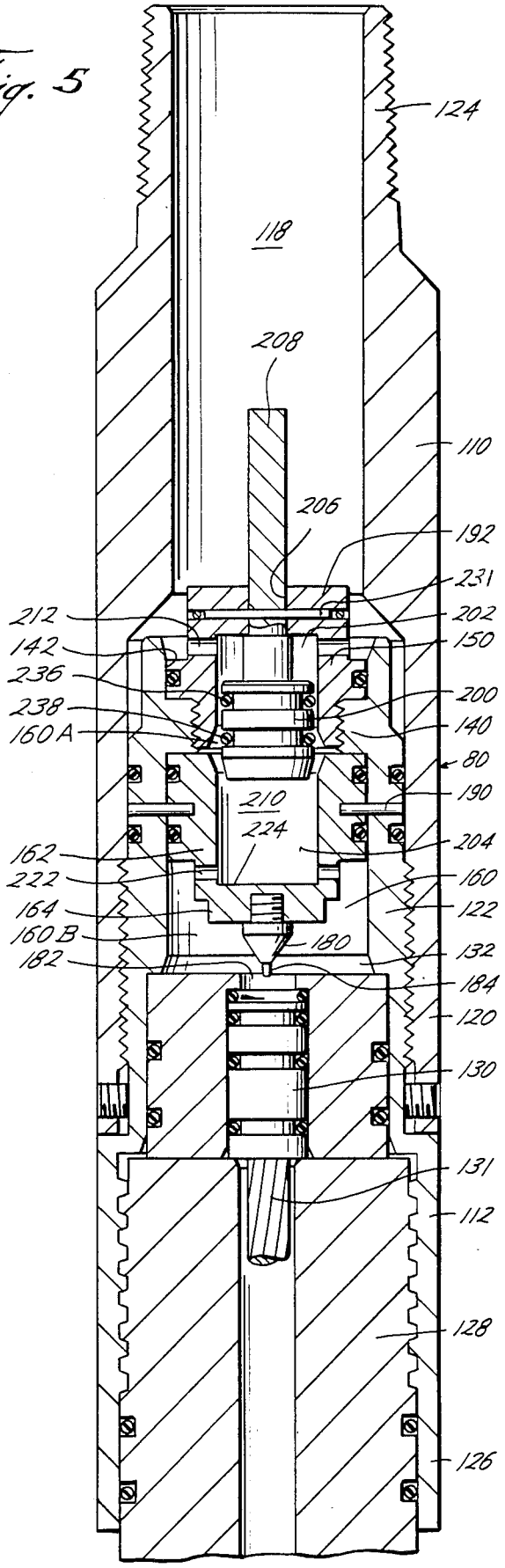
FIG. 5 is an enlarged cross-sectional view of a pressure actuating firing head.

Referring now to FIG. 5, the pressure actuated firing head 80 includes a tubular housing composed of an upper cylinder 110 and a lower mandrel 112. An axial fluid passageway 118 extends the length of cylinder 110 and includes a counterbore forming box 120 at the lower end thereof for telescopically receiving a reduced diameter portion or pin 122 on mandrel 112. A tapered threaded pin 124 is disposed at the upper end of cylinder 110 for making connection with the lowermost end of connector string 32. Axial passageway 118 extends upwardly into the flowbore of connector string 32.

Mandrel 112 includes a lower threaded box end 126 for threadingly receiving the upper end of sub 128 of perforating gun 60. Pin 122 extends above box end 128 and has a central bore 132 for receiving initiator 130, hereinafter described. Central bore 132 is restricted near its upper end by an inwardly directed annular shoulder 140 which forms an insert counterbore 142 for receiving a closure assembly 150. Annular shoulder 140 forms a chamber 160 therebelow with the lower portion of central bore 132. Chamber 160 houses a piston 162.

Piston 162 is slidingly received by chamber 160 for reciprocation therein. Piston 162 includes a reduced diameter lower end 164 which supports a firing pin 180 positioned on piston 162 to be received by entry bore 182 to initiator 130 when piston 162 is moved to its lowermost position. Firing pin 180 includes a point 184 for impacting and setting off initiator 130. Initially piston 162 is secured by shear pins 190 in an uppermost position and shear pins 190 are sized to shear upon the application of a predetermined force on the upper face of piston 162.

Closure assembly 150 is mounted within pin 122 to open and close fluid communication with chamber 160. Assembly 150 includes a bonnet 192 threadingly engaging annular shoulder 140. A piston member, plunger or plug 200 is reciprocally received within cylinder 210 formed by cooperating blind bores 202, 204 in bonnet 192 and piston 162, respectively, having a common inner diameter. Bonnet bore 202 has a hole 206 for slidably receiving a shaft or stem 208 on plug 200 extending upwardly therethrough. Bonnet bore 202 is part of a fluid flow path which ultimately extends to the surface. A plurality of radial fluid ports 212 extend from bonnet bore 202 to the exterior of bonnet 192 and into axial flow passage 118. Initially, as shown in FIG. 5, plug 200 is in the upper position preventing any fluid flow between axial passageway 118 and chamber 160. Plug 200 is held in the upper position by shear pin 231 sized to shear upon the application of a predetermined fluid pressure within passageway 118 from the surface.

Shear pin 231 determines the amount of fluid pressure required in passageway 118 to actuate firing head 80. Shear pin 231 may be sized, for example, to shear at a predetermined pressure of approximately 2,000 to 3,000 psi above hydrostatic pressure. The hydrostatic pressure is the heavier of the hydrostatic head in the lower casing annulus 28 or the flow bore of tubing string 22. Thus, shear pin 231 must be heavy enough to insure that is not sheared by the largest hydrostatic head in the well.

Piston bore 204 also has a plurality of radial fluid ports 222 located adjacent the bottom 224 of piston bore 204 permitting pressure equalization between that portion of chamber 160 above piston 162, i.e., 160A, and that portion of chamber 160 below piston 162, i.e., 160B. So long as piston ports 222 are open, the pressure will be equal in upper chamber 160A and lower chamber 160B. Such pressure will be substantially atmospheric. Should fluid leak into chamber 160A, ports 222 will also permit fluid communication into chamber 160B and thereby prevent a premature detonation due to the application of fluid pressure on piston 162.

A ported sub or nipple 230 (See FIG. 2) is series connected in connector string 32. Ported sub 230 includes ports 232 to provide fluid communication between lower borehole annulus 28 and axial passageway 118 of pressure actuated firing head 80. Shear pin 231 is sheared by increasing the fluid pressure in axial passageway 118 which, when applied to the cross-sectional area of stem 208 projecting into passageway 118 and to the remaining cross-sectional area of plug 200 in that portion of bonnet bore 202 above plug 200 via bonnet ports 212, the force will reach the predetermined amount required to shear pin 231. The pressure on plug 200 and stem 208 causes plug 200 to move downwardly in cylinder 210, passing from bonnet bore 202 and unsealing bonnet ports 212. Plug 200 then moves downwardly into piston bore 204 where seal members 236, 238 sealingly engage the piston bore 204 where seal members 236, 238 sealingly engage the cylindrical wall of piston bore 204 and seal off piston ports 222.

By unsealing bonnet ports 212, the fluid from axial passageway 118 now flows into upper chamber 160A. Further, because plug 200 has now sealed piston ports 222, a pressure differential is effected across piston 162. Upon the application of this increased fluid pressure onto the upper face of piston 162 and the impact of plug 200 engaging bottom 224 of piston bore 204, pins 190 are sheared.

Upon shearing pins 190, piston 162 moves downwardly in chamber 160 with the point 184 of firing pin 180 impacting initiator 130 to detonate the charges of perforating gun 60. Piston 162 snaps downwardly to provide a substantial impact of pin 180 with initiator 130.

Figure 3:
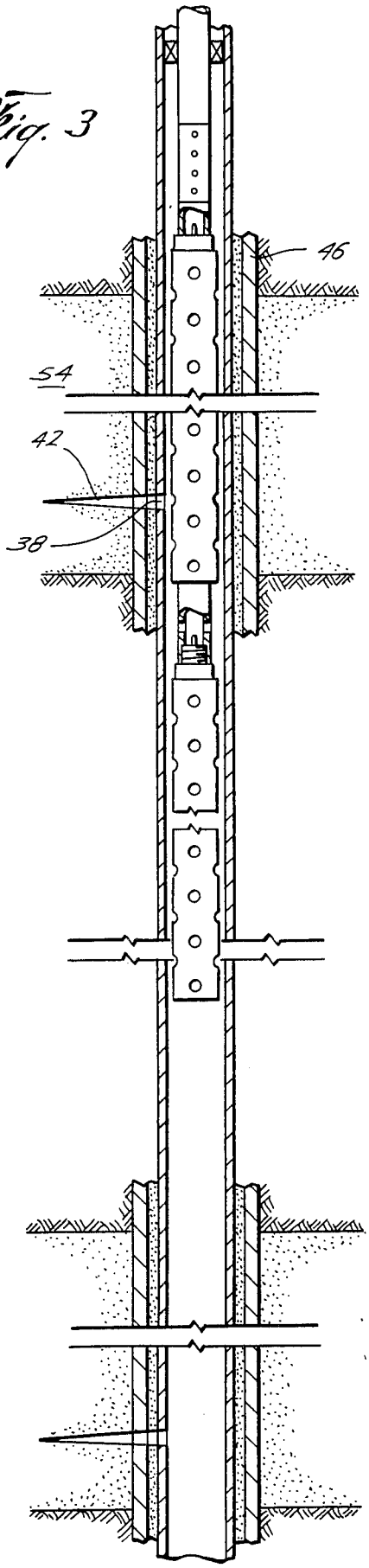
FIG. 3 is a partly diagrammatic, partly cross-sectional view of the apparatus disclosed in FIG. 2 in position to perforate the upper formation.

Referring now to FIGS. 2 and 3 showing the operation of the present apparatus and method, FIG. 2 illustrates the apparatus during the perforation of lower hydrocarbon-containing formation 14, and FIG. 3 illustrates the apparatus aligned for the perforation of upper hydrocarbon-containing formation 12.

Referring first to FIG. 2, the following assembly is disposed on the end of tubing string 22: packer 20, perforated nipple 30, upper perforating gun 50 with firing head 70, connector string 32 with ported sub 230 series connected therewith, and lower perforating gun 60 having pressure actuated firing head 80. Tubing string 22, with such assembly, is lowered into cased borehole 10 until lower perforating gun 60 is adjacent lower formation 14. Packer 20 is set forming upper annulus 26 and lower annulus 28. Packer 20 forms a seal between casing 16 and tubing string 22, thus creating a closed system around the assembly.

For the actuation of lower perforating gun 60 and the perforation of lower formation 14, the hydrostatic pressure of the well fluids in the flowbore of tubing string 22, lower annulus 28, and passageway 118 is increased by pump pressure at the surface. Such pressure is effected down the flowbore of tubing 22, through perforated nipple 30, down lower borehole annulus 28, through ports 232 of ported sub 230, and subsequently effected on stem 208 and plug 200 via ports 212 in bonnet 192.

Although normally the fluid pressure will be hydraulic pressure from a liquid, it is possible that a gas may be used to actuate head 80. Further, fluid pressure may be effected in passageway 118 down upper annulus 26 and lower annulus 28 by not setting packer 20. Pressure actuated head 80 may be actuated by pressuring down any designed flowpath communicating the surface with passageway 118.

The pressure effected in passageway 118 is hydrostatic pressure plus a safety margin pressure such as 20% of hydrostatic pressure or generally about 2,000 to 3,000 psi. The heaviest hydrostatic pressure in the well is used to calculate the predetermined pressure required to shear pin 231 and actuate firing head 80. Once the fluid pressure in passageway 118 exceeds the predetermined pressure limit for shear pin 231, pin 231 shears and frees plug 200 to move downwardly.

Once plug 200 is received within cylinder 210 and piston ports 222 are sealed, a substantial pressure differential is created across plug 200 and piston 162. On the upper face of plug 200 and piston 162 is hydrostatic pressure plus 2,000 to 3,000 psi and on the lower face of piston 162 is atmospheric pressure. This large pressure differential causes piston 162 with plug 200 to snap downwardly. The force of impact between firing pin 180 and initiator 130 initiates prima cord 131 which in turn detonates the shaped charges of perforating gun 60. Formation 14 is thereby perforated forming perforations 36 and tunnels 40 permitting the hydrocarbons from formation 14 to flow into lower annulus 28 and up to the surface. The well is then tested, shut in, or completed.

Referring now also to FIG. 3, after the lower formation 14 has been perforated, packer 20 is unset, string 22 and its assembly are raised until upper perforating gun 50 is aligned with upper formation 12. Packer 20 is then reset. Firing head 70 on upper perforating gun 50 is then actuated by dropping a weight, such as a bar or go-devil down tubing string 22 to impact plunger 88 driving firing pin 92 into initiator 100. Initiator 100 then ignites prima cord 104 to detonate the shaped charges of upper perforating gun 50. Gun 50 then perforates casing 16, cement 18, contaminated zone 42, and uncontaminated formation 54, thus forming perforations 38 and tunnels 40. Both formations can then be produced.

Several advantages are apparent from this apparatus and method. The first being that it is less expensive since there is not need for hermetically sealed tubing or expertise required for assembly. Further, there is not need for several hundred feet of prima cord, along with booster caps, extending from the upper gun to the lower gun. Also, the method is more reliable since there is less opportunity for the prima cord to get wet and become inoperable. The present invention further provides the flexibility of perforating two or more formations at different times rather than simultaneously. Also, each such formation may be individually tested. Other objects or advantages of the invention are apparent from the present description.

Referring now to FIG. 6, another embodiment of the method of the present invention is disclosed. In this method, both formations 12 and 14 may be perforated almost simultaneously or at different times, but without manipulating tubing string 22 and packer 20. As shown in FIG. 6, with reference to the prior art shown in FIG. 1, upper formation 12 and lower formation 14 have a vertical depth of A and B respectively, and the distance between formations 12 and 14 is shown as C, which may be several hundred feet. Borehole 10 extends through upper hydrocarbon-containing formation 12 and lower hydrocarbon-containing formation 14. The same basic assembly as illustrated in FIGS. 2 and 3 is used in the method of FIG. 6, except that connector string 240 spans the entire distance C between formations 12 and 14. Again tubing string 22 is suspended down borehole 10 with packer 20 separating annulus 24 into an upper annulus 26 and a lower annulus 28. Tubing string 22 supports perforated nipple 30 on its lower end below packer 20. Perforated nipple 30 supports impact actuated perforating gun 50, which has connector string 240 suspended from it. Connector string 240 includes perforated nipple 230 near its lower end and supports pressure activated perforating gun 60.

Formations 12 and 14 are individually perforated by first pressure actuating lower perforating gun 60 and subsequently dropping a go-devil to actuate upper perforating gun 50. In such an operation, pressure is effected down tubing string 22 by raising pump pressure to activate pressure actuated perforating gun 60 and perforating lower formation 14. A go-devil is then dropped down tubing string 22 to actuate impact actuated perforating gun 50 to perforate upper formation 12.

This method is less expensive than the prior art methods because the connector string 240 does not have to be sealed, no prima cord is required between the two guns; no booster caps are required; and the string can be made up in the field. This method has the further advantage of avoiding the resetting of packer 20. In certain environments, it is necessary that a permanent packer be used.

Figure 7:
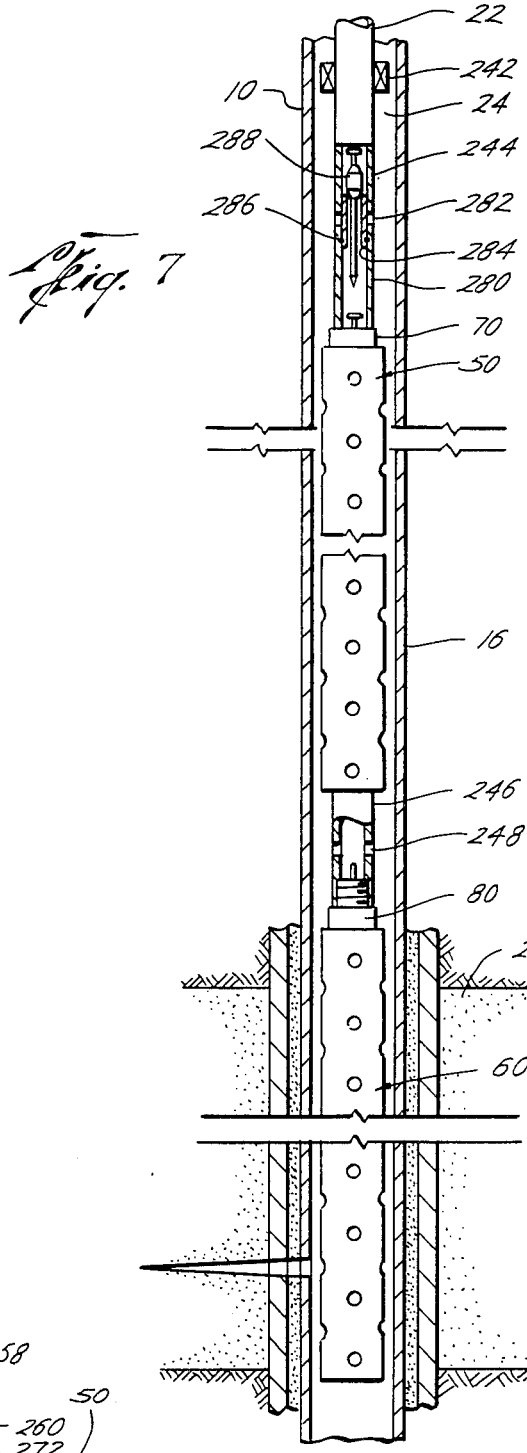
FIG. 7 is a partly diagrammatic, partly cross-sectional view of the embodiment in FIG. 2 in a wellbore having a formation which is to be perforated twice.

Referring now to FIG. 7, still another embodiment of the apparatus and method of the present invention is disclosed. The previously described embodiments of FIGS. 2 through 6 actuate firing head 80 disposed on lower perforating gun 60 by effecting hydrostatic pressure on the well fluid in the flowbore of tubing string 22, through perforated nipple 30, and down lower borehole annulus 28. Subsequently, the pressure is applied to stem 208 of plug 200 in firing head 80 via ports 232 of ported sub 230. However, as previously indicated, the elevation of pressure in passageway 118 to actuate firing head 80 may be effected by pressuring down any flow path communicating the surface with passageway 118. FIG. 7 illustrates the actuation of pressure actuated firing head 118 by effecting pressure from the surface down annulus 24 since the method for firing lower gun 60 does not include setting packer 20 and forming an upper annulus 26 and a lower annulus 28. It should be understood that the method of actuating lower gun 60, as illustrated in FIG. 7, down annulus 24 may be easily adapted for the method described with respect to FIGS. 2 through 6 by replacing nipple 30 with a bar actuated vent assembly as described in U.S. Pat. No. 4,299,287, as hereinafter described in detail.

FIG. 7 also illustrates the application of the present invention in another environment. As shown in FIG. 7, the borehole 10 extends through only one hydrocarbon-containing formation 250 as distinguished from the environment of FIGS. 2 through 6 showing multiple formations. In this environment, it is desired to more densely perforate the formation than is possible with only one perforating gun in one trip into the well. The number of charges disposed within a perforating gun per lineal foot is limited by the physical size of the shaped charges. Where it is desirable to have more perforations per foot than the normal four, it is desirable to be able to perforate the same perforation twice thereby substantially increasing the number of perforations in the formation, particularly where that formation has limited exposure to borehole 10 such as a thin formation.

The apparatus used in accomplishing the above objectives includes a tubing string 22 having mounted thereon a packer 242, a bar actuated vent assembly 244, upper perforating gun 50 with impact actuated firing head 70, a ported sub 246 with ports 248, and a lower perforating gun 60 with pressure actuated firing head 80.

Bar actuated vent assembly 244 is shown and described in detail in U.S. Pat. No. 4,299,287 which is incorporated herein by reference. Generally, bar actuated vent assembly 244 includes a sub 280 having radial ports 282 and a cylindrical piston 284 mounted within sub 280 so as to close radial ports 282 to fluid flow. Sealing means are provided for sealing piston 284 with sub 280 above and below ports 282. As distinguished from perforated nipple 40 disclosed in the embodiments of FIGS. 2 through 6 which permitted well fluids to flow into the flowbore of tubing string 22 as the string was lowered into borehole 10, vent assembly 244 will prevent such well fluids from flowing into tubing string 22 until a bar 288 is dropped down the flowbore of tubing string 22 and engages the upper end of piston 284 to shear pins 286 and permit piston 284 to move downwardly in sub 280 and open radial ports 282 to fluid flow. Radial ports 282 permit the flow of hydrocarbons from the formation, via annulus 24 and the perforations, into the flowbore of tubing string 22 for transport to the surface.

In operation, string 22 is lowered into borehole 10 with a flow communication means such as bar actuated vent 244 supported near its lower end. Upper perforating gun 50 is supported below vent 244 with ported sub 246 extending between upper gun 50 and lower perforating gun 60. String 22 is lowered into borehole 10 until lower gun 60 is aligned with formation 250 to be perforated. Packer 242 is not set at this time to permit fluid communication from the surface down annulus 24 and through ported sub 246. To actuate lower gun 60, pump pressure is applied at the surface down annulus 24 and into passageway 118 of firing head 80, via ports 248 in ported sub 246. Upon the pressure in passageway 118 reaching a predetermined amount, shear pins 230 are sheared (see FIG. 5) and pressure actuated firing head 80 proceeds to detonate the shaped charges in lower gun 60 to perforate formation 250. It should of course be noted that annulus 24 forms a closed system around lower gun 60 since formation 250 does not, at this time, have perforations. However, once formation 250 is perforated, it is only with great difficulty that pressure can be effected down annulus 24 for actuation purposes since the fluid pressure merely is displaced into the formation 250 via the new perforations.

Since vent assembly 244 is closed to fluid flow, the flowbore of tubing string 22 may be completely dry or have a predetermined fluid cushion or hydrostatic head of a light distillate, as for example. The hydrostatic head of well fluids in flowbore annulus 24 is greater than the formation pressure to control the well until the setting of packer 242. Thus, formation 250 is perforated in an overbalanced condition, i.e., the hydrostatic pressure in annulus 24 is greater than the formation pressure. It is often desirable to form perforations in a formation where the well is completed in an underbalanced condition, i.e., the hydrostatic head in annulus 24 is less than the formation pressure.

Therefore, prior to the detonation of upper gun 50, it is desirable to reduce the hydrostatic head in tubing string 22 to a predetermined pressure less than the formation pressure to obtain a desirable underbalance or pressure differential towards the flowbore of tubing string 22 via ports 282 in vent 244. Thus, that portion of the flowbore of tubing string 22 above gun 50 may be substantially dry or include a predetermined column of fluid such as water, diesel, or light crude. By maximizing the underbalance, using a jet type casing perforator gun, deeply penetrating perforations are provided with an immediate cleanup of the perforations due to high backsurge pressures resulting in maximum flow from formation 250. Perforating with high differential pressure toward annulus 24 backsurges the formations and tunnels to flush out debris and compaction caused by the cementing and perforating operations.

Therefore, once lower perforating gun 60 has perforated formation 250 in the overbalanced condition, the tubing string 22 is lowered until upper perforating gun 50 is adjacent formation 250. At that time, packer 242 is set to form lower borehole annulus 28 and upper borehole annulus 26 as described previously with respect to the embodiments of FIGS. 2 through 6.

In the detonation of upper gun 50 and the second perforation of formation 250, bar 288 is dropped down the flowbore of tubing string 22. Bar 288 impacts piston 284 shearing pins 286 and opening radial ports 282. The bar continues downwardly a predetermined distance and impacts plunger 88 of impact firing head 70. Perforating gun 50 is then detonated to provide additional perforations in formation 250.

In this method of the present invention, not only are the perforations formed by upper gun 50 backsurged, but the perforations formed by lower gun 60 are also backsurged. Upon setting the packer 242, production from formation 250 through the perforations created by the detonation of lower gun 60 is stopped permitting the build-up of formation pressure. Upon opening a flow communication means between the flowbore of tubing string 22 and annulus 24 such as vent 244, the pressure is released to backsurge these perforations too.

It should be understood that this method may be applied to the previously described embodiments of FIGS. 2 through 6 whereby the lower formation 14 could be perforated in an overbalanced condition and then later backsurged in an underbalanced condition upon the perforation of upper formation 12.

Figure 8:
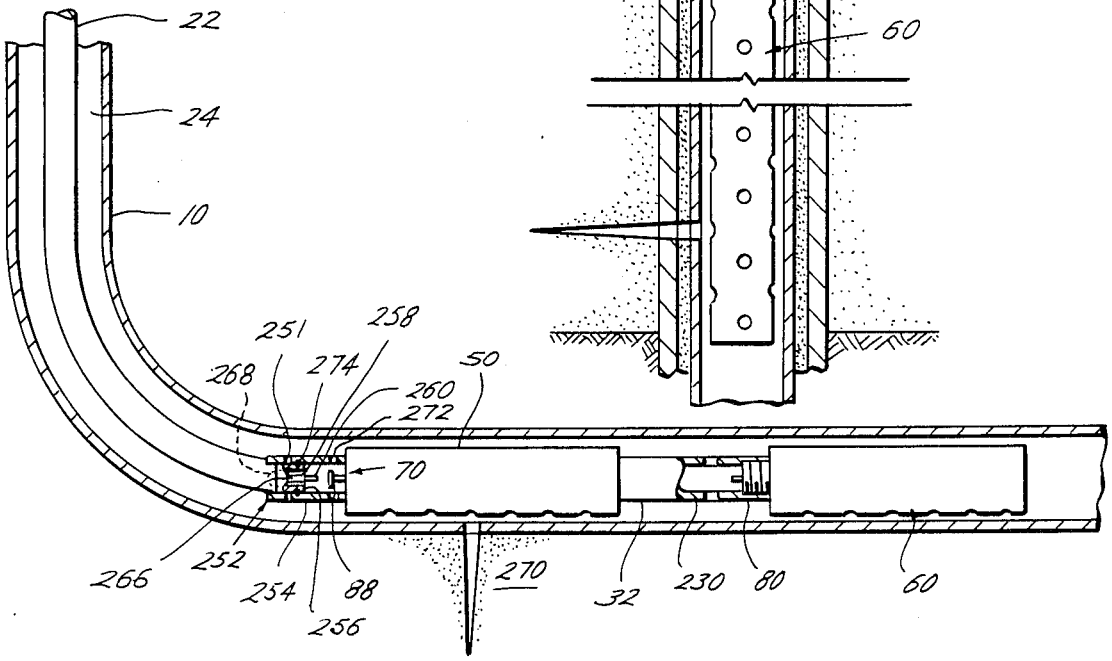
FIG. 8 is a partly diagrammatic, partly cross-sectional view of a highly deviated well and an apparatus made in accordance with the present invention.

Referring now to FIG. 8, there is dislcosed still another embodiment of the method. In this case, it is desirable to perforate an extremely deviated borehole 10. FIG. 8 shows a schematical representation of a deviated borehole for purposes of illustration of this method.

The assembly for use with this method, disposed on the end of tubing string 22, includes a vent and gun actuation assembly 252, upper perforating gun 50 with firing head 70, connector string 32 with ported sub 230 series connected therewith, and lower perforting gun 60 having pressure actuated firing head 80. A bar or go-devil cannot be used to actuate firing hed 70 since the deviated angle of tubing 22 prevents sufficient impact of the go-devil against the plunger to actuate and detonate the initiator. Thus, it is necessary that firing head 70 be actuated by means not requiring gravitational force. Thus, vent and actuation assembly 252 is series connected just above firing head 70. Vent and actuation assembly 252 is described in detail in U.S. patent application Ser. No. 493,081 filed May 9, 1983 now U.S. Pat. No. 4,548,991 entitled "Ball Switch Device and Method" which is incorporated herein by reference.

Vent and actuation assembly 252 includes a sub 254 having threads at the opposite marginal ends thereof so that the sub can be threadingly made up into tubing string 22. A piston 256 is slidingly received in close tolerance realtionship within sub 254. The lower end of piston 256 is provided with radially spaced apart circulation ports 258 which are arranged circumferentially about the longitudinal axial center line of sub 254 and parallel to the axial center line of tubing string 22. A firing rod 260 is axially aligned with respect to tubing string 22 and includes a fixed end which is affixed to the lower end of piston 256. The firing rod downwardly extends from piston 256 and terminates at a free end. Piston 256 includes an axial passageway 266 in fluid communication with ports 258.

Sub 254 includes radially spaced apart vents 251 covered by annulr piston 256 so as to be in the normally closed position. Circumferentially extending seals establish sealing between the innerface of the exterior of piston 256 and the interior of sub 254.

In this method, upper and lower guns 50, 60 are lowered down borehole 10 on the lower end of tubing string 22 until lower gun is aligned with formation 270 to be perforated. Pressure is increased by pumping down tubing string 22 until the pressure actuated firing head 80 of gun 60 is actuated and the shaped charges in lower perforating gun 60 are detonated. Shear pin 230 in gun 60 will shear at a pressure of 2,000 to 3,000 psi above the hydrostatic pressure. After lower gun 60 has been detonated, tubing string 22 is again lowered until upper perforating gun 50 is aligned with formation 270.

A sphere 268 is then circulated down the flowbore of tubing string 22 with the circulating fluid passing around plunger 88 and through ports 272 and up annulus 24 to the surface. Sphere 268 becomes seated on the upper end of piston 256 thereby closing axially passageway 266 to fluid flow. Further pressure down tubing string 22 causes shear pins 274, holding piston 256 in place within sub 254, to shear and permit piston 256 to move downwardly. The free end 264 of firing rod 260 thereby engages head 89 of plunger 88 on firing head 70 so as to actuate upper perforating gun 50. Upper gun 50 then provides additional perforations for formation 270.

While a preferred embodiment of the invention has been shown and described, modifications thereof can be made by one skilled in the art without departing from the spirit of the invention. For example, although the preferred embodiments of the present invention have described disposing pressure actuated firing head 80 on the top of lower perforating gun 60 necessitating a ported sub, such as subs 230, 246, firing head 80 may be mounted on the lower end of perforating gun 60 as taught in U.S. patent application Ser. No. 481,074 filed Mar. 31, 1983 thereby eliminating the need for a ported sub.

I claim:

1. In a cased wellbore having a pipe string extending downhole through at least one formation and supporting first and second perforating guns, the method of perforating the well comprising:

forming a fluid passageway to the first perforating gun for the pressure actuation thereof;

closing the flowbore of the pipe string to the fluids in the annulus;

establishing a pressure in the flowbore of the pipe string tht is less than the formation pressure;

effecting fluid pressure down the passageway to actuate the first perforating gun;

opening the flowbore of the pipe string to flow from the annulus prior to the actuation of the second perforating gun; and actuating the second perforating gun.

2. The method of claim 1 further including after the actuation of the first perforating gun, aligning the second perforating gun adjacent a formation.

3. The method of claim 1 wherein the step of forming a fluid passageway includes the step of forming a fluid passageway from the surface down the casing annulus.

4. In a cased wellbore having a tubing string extendin downhole and supporting first and second perforating guns in tandem, the first perforating gun being aligned with a hydrocarbon-bearing formation, the method of perforating the well comprising:

actuating the first perforating gun, thus detonating the charges and perforating the formation;

aligning the second perforating gun with another hydrocarbon-bearing formation; and actuating the second perforating gun by dropping a weight down the tubing string to impact the firing head of the second perforating gun, thus detonating the charges and perforating the another formation.

5. The method of claim 4 further including the step of forming a flow path from the surface to the first perforating gun and effecting fluid pressure down the flow path for actuating the first perforating gun.

6. The method of claim 5 wherein the step of forming a flow path includes the step of forming a flow path from the surface down the annulus between the casing and tubing string.

7. The method of claim 5 wherein the step of forming a flow path includes the step of forming a flow path from the surface down the flowbore of the tubing string to the firing head of the first perforating gun.

8. The method of claim 7 further including the steps of positioning the second perforating gun above the first perforating gun, closing the annulus between the casing and tubing string above the second perforating gun, and forming a portion of the flow path around the second perforating gun to the firing head of the first perforating gun.

9. The method of claim 8 wherein the step of closing the annulus includes the step of setting a packer.

10. The method of claim 9 further including prior to the step of aligning the second perforating gun, the steps of releasing the packer, moving the second perforating gun to another formation, and after aligning the second perforating gun, resetting the packer.

11. The method of claim 5 wherein the step of effecting fluid pressure, includes the step of raising the fluid pressure in the flow path to a predetermined amount.

12. The method of claim 4 further including, after the step of perforating the first formation, the step of testing the first formation.

13. In a cased wellbore having a tubing string extending downhole through first and second formations and supporting first and second perforating guns, the method of perforating the formation comprising:

aligning simultaneously the first perforating gun with the first formation and the second perforating gun with the second formation;

actuating the first perforating gun to perforate the first formation; and actuating subsequently the second perforating gun by dropping a weight down the tubing string to impact the firing head of the second perforating gun to perforate the second formation.

14. The method of claim 13 further including the step of forming a flow path from the surface to the first perforating gun and effecting fluid pressure down the flow path for actuating the first perforating gun.

15. The method of claim 13 further including the step of spacing the first and second perforating guns as to align the guns with the first and second formations respectively.

16. In a cased wellbore having a tubing string extending downhole and supporting first and second perforating guns in tandem, the first perforating gun being aligned with a hydrocarbon-bearing formation, the method of perforating the well in a single trip into the well comprising:

actuating the first perforating gun, thus detonating the charges and perforating the formation;

aligning the second perforating gun with the formation; and actuating the second perforating gun by dropping a weight down the tubing string to impact the firing head of the second gun, thus detonating the charges and additionally perforating the formation.

17. The method of claim 16 further including the step of forming a flow path from the surface to the first perforating gun and effecting fluid pressure down the flow path for actuating the first perforating gun.

18. The method of claim 17 wherein the step of forming a flow path includes the step of forming a flow path from the surface down the annulus between the casing and tubing string.

19. The method of claim 18 further including the step of closing the flow bore of the tubing string to the fluids in the annulus prior to the actuating of the first perforating gun.

20. The method of claim 19 further including the steps of:

closing the annulus between the casing and tubing string above the guns;

establishing a pressure in the flowbore that is less than the formation pressure; and opening the flowbore to the flow from the annulus prior to the actuation of the second perforating gun.

21. The method of claim 20 wherein the steps of opening the flowbore includes the step of dropping a weight down the tubing string to open a vent assembly.

22. The method of claim 17 wherein the step of forming a flow path includes the step of forming a flow path from the surface down the flowbore of the tubing string to the firing head of first perforating gun.

23. The method of claim 22 further including the steps of positioning the second perforating gun above the first perforating gun, closing the annulus between the casing and tubing string above the second perforating gun with a packer, and forming a portion of the flow path around the second perforating gun to the firing head of the first perforating gun.

24. The method of claim 23 further including prior to the step of aligning the second perforating gun, the steps of releasing the packer, moving the second perforating gun to the formation, and after the step of aligning the second perforating gun, resetting the packer.

25. In a cased wellbore having a pipe string extending downhole through at least one formation and supporting first and second perforating guns, the method of perforating the well, comprising:

forming a fluid passageway from the surface down the flowbore of the pipe string and to the second perforating gun;

effecting fluid pressure down the passageway to actuate the second gun;

actuating the second gun;

closing the passageway above the first gun;

exerting fluid pressure down the flowbore of the pipe string onto a piston;

moving the piston toward the first gun; and actuating the first gun by striking the firing head of the first gun with the piston.

26. The method of claim 25 wherein said closing step includes the steps of pumping a sphere from the surface downhole and blocking flow through the passageway above the piston.

27. The method of claim 25 further including after the step of actuating the second gun, aligning the first gun adjacent a formation.

28. A well apparatus supported by a pipe string extending downhole in a cased wellbore through at least one formation and forming an annulus with the cased wellbore, comprising:

a first perforating gun;

a second perforating gun having a pressure actuated firing head;

connecting means for connecting said second perforating gun to said first perforating gun;

means for actuating said first perforating gun;

means for pressure actuating said second perforating gun;

means for closing the annulus above said first and second perforating guns;

fluid communication means providing fluid communication between the flowbore of the pipe string above said first and said second perforating gun and the annulus below said closing means;

means for closing said communication means; and means for opening said communication means.

29. The apparatus of claim 28 wherein said connecting means includes a pipe extending between said first and second perforating guns and spacing said first and second perforating guns for simultaneously aligning said first and second perforating guns with different formations.

* * * * *